United States Patent [19]

Culling

[11] Patent Number: 4,985,091

[45] Date of Patent: Jan. 15, 1991

[54] CORROSION RESISTANT DUPLEX ALLOYS

[75] Inventor: John H. Culling, St. Louis, Mo.

[73] Assignee: Carondelet Foundry Company, St. Louis, Mo.

[21] Appl. No.: 464,233

[22] Filed: Jan. 12, 1990

[51] Int. Cl.[5] ..... C22C 38/42

[52] U.S. Cl. ..... 148/325; 420/61

[58] Field of Search ..... 148/325; 420/61

[56] References Cited

U.S. PATENT DOCUMENTS

| | | | |
|---|---|---|---|
| 3,082,082 | 3/1963 | Bidwell et al. | 148/325 |
| 4,721,600 | 1/1988 | Maehara et al. | 148/325 |
| 4,798,635 | 1/1989 | Bernhardsson et al. | 148/325 |

FOREIGN PATENT DOCUMENTS

| | | | |
|---|---|---|---|
| 54-121223 | 9/1979 | Japan | 148/325 |

*Primary Examiner*—Deborah Yee

*Attorney, Agent, or Firm*—Senniger, Powers, Leavitt & Roedel

[57] ABSTRACT

Low-nickel, low-molybdenum, air-meltable air-castable, fabricable, weldable, duplex stainless steel alloys of an austenitic-ferritic matrix that are essentially free of martensite and sigma phase. The alloys are not only substitutable for the various austenitic 18% chromium - 8% nickel grades of stainless steels but possess superior corrosion resistance properties to those prior art steels. The alloys consist essentially of between about 2% and about 5% of weight nickel, between about 23% and 28% by weight chromium, between about 0.50% and about 1% by weight molybdenum, between about 0.50% and about 4% by weight copper, between about 0.10% and about 0.60% by weight tungsten, between about 0.08% and about 0.32% by weight nitrogen, up to about 2% by weight manganese, up to about 1% by weight silicon, up to about 0.08% by weight carbon, and the balance essentially iron. The alloys may optionally contain up to about 0.45% by weight vanadium, up to about 0.65% by weight columbium, up to about 0.6% by weight cobalt, up to about 0.0007% by weight boron, up to about 0.6% by weight tantalum and up to about 0.5% by weight titanium.

16 Claims, No Drawings

CORROSION RESISTANT DUPLEX ALLOYS

BACKGROUND OF THE INVENTION

All useful ferrous-base and nickel-base corrosion-resistant alloys have generally been formulated from the same group of chemical elements, and all important advances in the field have been based upon the discoveries of new and useful proportions of these same chemical elements. Each of these types of alloys contains at least two of the most important or useful elements, iron, nickel, chromium, molybdenum and manganese, along with at least very small amounts of the generally undesirable carbon, phosphorus and sulfur. Some formulations further contain one or more of the group, copper, nitrogen, silicon, columbium, titanium, and, rarely, tungsten or aluminum. Those additional elements that have been explored but which have never achieved any significant usage in the field are calcium, magnesium, zirconium, beryllium, yttrium, boron, antimony, platinum, palladium, tantalum, lead, selenium, tellurium, cerium, lanthanum and mixtures of rare earth elements.

The austenitic stainless steels, containing a minimum of about 8% nickel and about 18% chromium, are several times more widely employed by tonnage than all other corrosion resistant alloys combined. They are the most resistant of ordinary stainless steels to industrial atmosphere sand aqueous acidic media except under strongly reducing conditions. They tend to be passive in media with a pH in excess of 3.0 and in oxidizing environments unless they contain undissolved chromium carbides and are employed in certain media. They are also generally passive in solutions at a pH of 2 to 10 and temperatures over about 150° F. unless chlorides are present. grades of these socalled 18% Cr-8% Ni type stainless steels have been developed for various applications by the inclusion of columbium (niobium), titanium or molybdenum or by maintaining carbon levels of about 0.03% maximum.

Ferritic, martensitic and precipitation-hardened grades of stainless steels have been employed to a much lesser extent to achieve special mechanical properties or because they are cost-effective in less demanding corrosion situations than those met by the 18% Cr-8 % Ni family of steels.

Some of the most typical characteristic properties of the 18% Cr-8% Ni type stainless steels are low yield strength in the annealed condition, good weldability, moderately poor machineability, high coefficient of thermal expansion, low coefficient of thermal conductivity, low hardness, non-magnetic face-centered-cubic matrix crystal structure, high tensile elongation, very high toughness and impact strengths at all temperatures, and pronounced tendency to harden and strengthen with cold or warm working, such as in rolling or extensive forging.

Two of the most undesirable characteristics of austenitic stainless steels are their low yield strengths, unless work-strengthened, and nickel contents, generally of 8% or higher. As to nickel content, nickel is a moderately scarce element in the earth's crust and not present in any known ore deposits in the United States. Nickel is far more expensive than the many other constituent elements, such as iron, chromium, molybdenum, silicon, manganese, copper and tungsten.

Accordingly, there have been extensive attempts to find substitute alloys of lower or no nickel contents that would provide comparable corrosion resistance with equal or perhaps somewhat superior mechanical properties to the 18-8 type alloys. These attempts have included high manganese steels coupled with fractions of a percent of nitrogen, very high purity ferritic steels, and, more recently, the duplex stainless steels. While each of these three types has found application, each has presented one or more problems as an 18% Cr-8% Ni stainless substitute.

The most promising of these types has been the duplex group of approximately half-ferritic half-austenitic matrix crystal structure stainless steels containing variously 22% to b 26.5% Cr, 4.8% to 10% Ni, 1.5% to 4.5% Mo, 0.0%-2% Cu, 0.15% to 0.25% N, 0.4% to 1.7% Si, 0.8% to 2% Mn and the balance essentially iron.

Compared to the 18% Cr-8% Ni types of stainless steels, the commercial grades of duplex alloys may be cast or wrought, have much higher yield strengths and hardnesses, lower thermal expansion and higher thermal conductivity, while maintaining adequate toughness and ductility when properly heat treated. Their main disadvantages have been problems encountered in fabrication and the very high temperature solution heat treatments required to secure the desired matrix structures. When properly heat treated, they have generally good resistance to intergranular pitting and crevice and galvanic corrosion as well as to stress corrosion cracking and erosion-corrosion.

The relatively high molybdenum content of present day commercial grades of duplex stainless steels (usually 1.5% to 4.5%) tends to cause the formation of hard, brittle, highly-corrodable sigma phase under certain conditions of heat treatment. The high molybdenum content along with the comparatively high chromium content also causes the known duplex stainless steels to freeze with an entirely ferritic structure during weld solidification. Austenite is formed through a solid-state phase transformation during post-solidification cooling. The result is an uneven division of nickel, chromium, molybdenum and nitrogen between the two phases after welding in structures that are much too large for post-weld heat treatment, such as pipe lines and large tanks. Consequently, there is a reduction in corrosion resistance at the weld.

It is obvious that any proposed duplex alloy of greater than about 8% Ni does not constitute a potentially lower nickel content substitute for 18% Cr-8% Ni stainless steels. Also, in alloys of the order of 30% to 35% Cr, greater than 3% Mo and large amounts of silicon or aluminum, there is a greater potential for sigma formation and poor welding qualities than in the present commercial duplex alloys. Alloys of greater than about 4% Mn content present special melting and casting problems and tend to form large amounts of primary delta ferrite and ultimately sigma phase when chromium levels exceed about 18%. Silicon and molybdenum also tend to promote the formation of sigma phase. While silicon content is held to low values in duplex stainless steels, molybdenum contents generally vary from about 1.5 to 4.5%. This in part accounts for their strong tendency to high hardness, low tensile elongations and fabricability problems even with high temperature solution annealing and rapid cooling. Also, manganese contents greater than about 2% tend to reduce resistance to local corrosion in chloride-bearing solutions.

As noted above, the main drawbacks of the current duplex stainless steels as substitutes for the 18% Cr-8% Ni family of steels have been fabrication and welding problems, moderately high hardnesses and a significant reduction in tensile elongation for the gains in yield strength obtained along with the required high temperature heat treatments necessary to avoid sigma phase or other undesirable structures. In general, the commercial duplex alloys have required solution heat treatments of from about 2000° (1093° C.) to 2260° F. (1238° C.) followed by drastic oil or even water quenching.

Accordingly, in spite of all prior efforts there still remains a need for alloys which are much closer in chemical properties to 18% Cr-8% Ni stainless steels but of reduced nickel content and of approximately equal or superior mechanical properties.

SUMMARY OF THE INVENTION

It is therefore an object of this invention to provide duplex stainless steel alloys which have corrosion resistance properties at least as good as those of the standard austenitic grades of stainless steels, particularly in corrosive conditions usually met by those steels, especially chloride-containing media, but with substantially lower nickel contents. An additional object is to provide duplex alloys with improved tensile elongation and fabricability properties, as compared with prior art duplex stainless steels, coupled with better yield strengths than annealed austenitic stainless steels. It is a further object to provide such alloys which may not require solution or other heat treatments in applications in which austenitic stainless steels do not require heat treatments.

Yet another object is to provide duplex alloys which may be readily melted and cast by ordinary practices and equipment without the requirement of special sands, molds, atmospheres or techniques. An even further object of the invention is to provide duplex alloys that are relatively tolerant to the presence of small quantities of the usual tramp elements as may be encountered in ordinary melting practices using new materials, ferroalloys or scraps and returns. A further object is to provide duplex stainless steels which, because they require less nickel than standard austenitic stainless steels, will be of equal or lower cost than those steels even though they possess even broader spectrum corrosion resistance.

These and other objects are fulfilled, according to this invention, which provides duplex stainless steel alloys which comprise, from about 2% to about 5% by weight Ni, from about 23% to about 28% by weight Cr, from about 0.50% to about 1% by weight Mo, from about 0.08% to about 0.32% by weight N, from about 0.50% to about 4% by weight Cu, from about 0.10% to about 0.60% by weight W, up to about 2% by weight Mn, up to about 1% by weight Si, up to about 0.08% by weight C, and the balance essentially iron. The alloys may optionally contain up to about 0.45% by weight V, up to about 0.65% by weight Cb, up to about 0.6% by weight Co, up to about 0.007% by weight B, up to about 0.6% by weight Ta and up to about 0.5% by weight Ti.

DETAILED DESCRIPTION OF THE INVENTION

The present invention is directed to duplex stainless steel alloys suitable as low-nickel substitutes for the standard (18o-8) austenitic grades of stainless steels in all cast, forged and wrought forms and shapes.

The major components of the alloys of the invention are:

| | |
|---|---|
| Nickel | 2-5% by weight |
| Chromium | 23-28% |
| Molybdenum | 0.50-1% |
| Copper | 0.50-4% |
| Nitrogen | 0.08-0.32% |
| Tungsten | 0.10-0.60% |
| Iron | essentially balance |

Nominally the alloys of the invention will also contain carbon, up to a maximum of about 0.08% by weight.

Optionally the alloys of the invention may further contain:

| | |
|---|---|
| Manganese | up to 2% |
| Silicon | up to 1% |
| Vanadium | up to 0.45% |
| Columbium | up to 0.65% |
| Tantalum | up to 0.6% |
| Titanium | up to 0.5% |
| Cobalt | up to 0.6% |
| Boron | up to 0.007% |

The various elements that can be employed in alloys of the invention have more than one effect in each case. Since a matrix structure of approximately half ferrite and half austenite is desired, (although a range of 40% to 60% ferrite and 60% to 40% austenite is acceptable), it is important to keep a balance between the various elements which favor one or the other structure. Those elements that promote the formation of austenite, listed in order of strongest effect to least effect, are carbon, nitrogen, nickel, manganese, cobalt and copper. Those elements which promote the formation of ferrite, in order of decreasing effect, are aluminum, silicon, titanium, columbium (niobium), vanadium, tantalum, molybdenum, chromium and tungsten.

Small amounts of boron, molybdenum, vanadium, tungsten, and nitrogen in solid solution all have beneficial effects upon resistance to local corrosion. Titanium, columbium, selenium, sulfur, tellurium and precipitates of carbides, borides and copper-rich epsilon phase all have varying degrees of detrimental effects upon resistance to local corrosion. Cobalt, tantalum, phosphorus and zirconium appear to have no significant effect upon local corrosion in alloys of the invention.

Since alloys of this invention must have a matrix structure of mixed austenite and ferrite, the minimum chromium level is 23% by weight so that, in combination with the proportions of the other elements, it will not form any substantial quantities of hard, brittle martensite that might form in the cooling of lower-chromium compositions. Chromium, molybdenum, tungsten and the optional elements, columbium, silicon, tantalum and vanadium all tend to promote the hard, brittle sigma phase upon slow cooling from high temperatures. Therefore, the ranges and limits of these elements are so chosen as to avoid formation of significant quantities of this phase in castings not intended for subsequent heat treatment. The presence of significant quantities of sigma phase is detrimental to fabricability and to corrosion resistance in many substances.

Sigma phase is composed of approximately 40% to 50% Cr in essentially iron-base alloys, but quantities of sigma phase may form when alloys of considerably less than 40% Cr content are held at elevated temperatures for prolonged periods. In any alloys, including those of the invention, nickel, carbon, nitrogen and cobalt all tends to raise the temperature ranges over which sigma phase will form, while nickel, molybdenum, and increasing quantities of chromium tend to slow down the rate of sigma phase formation.

The low silicon and molybdenum contents of the alloys of the present invention are in part responsible for such alloys having relatively lower hardness values, higher elongations and better fabricability, even, at times, without heat treatments.

Prior art duplex stainless steels tend to form sigma phase in the temperature range of about 1100° F. (593° C.) to 1650° F. (900° C.) and in larger quantities and at faster rates than the duplex alloys of this invention. In contrast, alloys of this invention tend to form sigma phase in the region of about 1000° F. (538°) to 1500° F. (816° C.) and at very much slower rates and in much smaller quantities, if at all.

The quantity of each of the elements in the alloys of the present invention, as well as the proportion of those elements to each other, was chosen so as to minimize the formation of martensite, sigma or other phases and to favor the formation of mixed austenite and ferrite structures. By maintaining the proper balance of these elements, along with the maximums of 28% Cr and 1% Mo, enables the desired effects to be achieved at the relatively low levels of 2% to 5% Ni. Thus, surprisingly, the content of ferrite-forming elements of the alloys of the invention, namely chromium, molybdenum, tungsten, vanadium, columbium, tantalum, and titanium, but especially the low molybdenum levels at the chromium levels present, in conjunction with the austenite-forming elements, manganese, nitrogen, cobalt and copper, only require about 2% to 5% of nickel, the main austenite-forming element.

The 23% to 28% Cr levels of the present invention compared to the 16% to 21% Cr levels of the standard (18-8) austenitic stainless steels, account, in part, for the equal or superior corrosion resistance of the instant alloys in many corrosive substances even though their nickel contents of 2% to 5% are much reduced from the 7% to 12% of the prior art alloys. Molybdenum is a further contributor to the corrosion resistance of the two stainless types, i.e., the alloys of the present invention versus standard austenitic steels. It is remarkable, however, that alloys of the present invention having 1% or less molybdenum content usually perform better in most corrosive situations than do the standard 316 and 317 type stainless steels with their 2% to 4% molybdenum content. Less than about 0.50% Mo is effective in conditions of milder corrosion but the corrosion resistance of alloys of the invention is remarkably improved over prior art alloys by having molybdenum contents above about 0.50% Mo.

Manganese in small amounts is an effective deoxidizer and enhances workability and weldability. However, it is held to a maximum of 2% in the alloys of the present invention, because high manganese contents have a tendency to reduce pitting resistance and to slightly reduce general corrosion resistance in some environments.

Very small amounts of boron enhance forgeability and resistance to certain types of corrosion such as intergranular corrosion in some substances. However, the boron content should not exceed solid solubility and is held to a maximum of 0.007% in the present invention.

Nickel and copper are mutually soluble in the solid state in all proportions, but copper is only soluble in iron or plain carbon steel at ambient temperatures and in the annealed equilibrium state up to about 0.35%. Upon slow cooling amounts greater than this will be precipitated in the form of epsilon solid solution from the saturated alpha (ferritic) iron solid solution. However, the gamma (austenitic) crystalline form of iron will hold up to 2.6% Cu in solid solution at the eutectoid temperature of 851° C. (1564° f.). The austenitic structure may be retained at or below room temperature by sufficient additions of nickel. Nickel also increases the solubility and chromium decreases the solubility of copper in iron-nickel-chromium-base alloys. The duplex alloys of the present invention will usually contain mixed matrix crystal structures of about half austenite and half ferrite. I have found that with a chromium content of about 25% and a nickel content of about 2%, my alloys will normally retain about 2.7% Cu in solid solution after slow cooling from high temperature. At about 5% Ni content, they will retain about 3% Cu in solid solution after very slow cooling and up to about 4% Cu in solid solution after rapid cooling following a solution heat treatment in the range of about 1500° F. (816° C.) to 2100° F. (1149° C.).

The precipitation of copper-rich globules of epsilon phase from solid solution will not adversely affect corrosion resistance of the instant alloys in some substances, but will severely reduce their resistance in many others, including food substances. Therefore, the copper contents of alloys of this invention are limited to a maximum of about 4% by weight of copper, preferably 3.7% max.

Upon slow cooling from the molten state, alloys of this invention readily retain, in the mixed austenite-ferrite matrix structure, about 1.6% to about 1.8% copper in solid solution. These particular alloys display excellent ductility and tensile elongation values. However, these properties decline in alloys of substantially higher copper content upon slow cooling from elevated temperatures if much copper precipitates.

In general, iron is passivated against corrosive attack in aqueous solutions only under a few very specialized circumstances. When chromium is added to iron in amounts greater than about 12% by weight, the resultant alloys are passivated under many more conditions. Nickel additions further enhance the ability of iron-chromium alloys to become passive under oxidizing conditions, but the presence of chloride ions tends to depassivate these iron-chromium-nickel alloys. On the other hand molybdenum additions to these iron-chromium and iron-chromium-nickel alloys tend to make them more easily passivated even in nonoxidizing acids and tend to offset the deleterious effects of chlorides. However, in the case of all stainless steels, or related nickel-base alloys, higher temperatures tend to reinforce the chloride harm and usually increase corrosion rates even in the absence of chlorides.

Copper additions to all of these alloys and to all iron-chromium and iron-chromium-nickel stainless steels, with or without molybdenum additions, will not appreciably affect their polarization properties in corrosive aqueous solutions but will instead facilitate the cathodic process, that is, the reduction of the oxidizing agent. Hence, in strong oxidizing chloride solutions, such as the 6% ferric chloride solution of the ASTM G-48 test, alloys of the present invention containing sufficient amounts of copper have greatly increased resistance to corrosive attack even at the relatively low nickel and molybdenum contents of these alloys. Therefore, in oxidizing conditions of high chloride contents, alloys of the invention are more resistant when they contain a sufficiently high (about 0.50% to 4%) copper content, even though the resultant formations (above about 1.8% copper) may then require high temperature solution heat treatments followed by rapid cooling. Thus copper in alloys of the present invention may vary from about 0.50% up to a maximum of 4%, depending upon the application.

Since alloys of the invention were developed so that they may be formulated from a wide variety of scraps and return materials as well as from new materials, they have considerable tolerance for tramp elements and such elements as may be encountered in scraps and recycled materials of various heat and corrosion resistant alloys. These elements include, but are not limited to cobalt, carbon, vanadium, columbium, tantalum, and titanium. Actually, vanadium, and often columbium and tantalum have been found to enhance corrosion resistance of the alloys of the invention under some circumstances as does titanium in some ranges. Carbon is the most deleterious of these elements in causing some forms of corrosion in many substances, particularly intergranular corrosion. This is true for standard stainless steels as well as for the duplex alloys of the invention.

In standard grades of austenitic stainless steels carbon up to a maximum of about 0.08% is well tolerated for applications encountering mildly corrosive substances. However, in many corrosive substances the precipitated chromium carbides at the grain boundaries can lead to catastrophic failure. Steels produced with the maximum carbon level of about 0.08% must be solution annealed at high temperatures and vary rapidly quenched to retain all of the carbon in solid solution at ambient temperatures. If such alloys are welded or subsequently heat treated at some lower temperature intergranular corrosive attack may take place.

Due to the higher affinity for certain elements other than carbon, alloys of the prior art often include other elements besides carbon in the formulation of stainless steels so that welding and various heat treatments may be performed without causing their usual propensity toward intergranular corrosive attack. It is thought that there would no be attack if one or more of the elements titanium, columbium, tantalum and vanadium is present in the minimum amounts given by the expression below, all elements on a weight percent basis:

$$\frac{\mathrm{Ti}}{5} + \frac{Cb}{8} + \frac{\mathrm{Ta}}{16} + \frac{V}{5.5} \geqq \mathrm{C}$$

However, it has been found that prolonged heating at about 1200° F. (649° C.) to 1600° F. (871° C.) will still result in some lower resistance to corrosion unless the total quantity of these so-called carbide stabilizers is increased to about 1.75 times the amounts indicated by the above formula. The alternative is to limit carbon levels in austenitic stainless steels to about 0.027% maximum, the amount held in solid solution even upon slower cooling.

It is also known that nitrogen combines with these same four carbide-stabilizing elements, so that the amount used may have to be increased above the theoretical vales of the above formulas (or above 1.75 times) when nitrogen is present. Whether the nitrogen or the lack of microhomogeneity is the cause for the required increase in stabilizing elements under the severest conditions of sensitization described above is not clear at present.

The situation concerning carbon in duplex stainless steels is similar to that for standard austenitic grades discussed above, so that many commercial grades of the duplex steels are formulated with 0.03% maximum carbon levels. Such a stringent requirement does, however, increases the cost of the resultant extra-low-carbon grades considerably.

In order to avoid this very low carbon restriction for alloys of the present invention that are intended for extremely severe corrosion service, quantities of vanadium, titanium, columbium or tantalum may be intentionally added. It has been found that the alloys of the invention do not require higher quantities of these elements than those stated by the above formula when carbon levels approach the high side of the range, despite the intentional nitrogen additions. This may in part be due to the higher chromium levels of the duplex alloys of the invention as compared to those of austenitic stainless steels, but it is probably more significantly due to the metallurgical effects of the duplex matrix structure. Thus, even with the highest carbon contents in the alloys of the invention, complete carbide stabilization for even the worst corrosive conditions can be achieved by the addition of any one of the elements titanium, columbium, or vanadium. Tantalum can also be used but the tantalum amount of allowable in the instant alloys is too low to permit tantalum alone to be used for this end, and furthermore, tantalum is very expensive and scarce and would not be deliberately selected for such a purpose. Nevertheless, tantalum may be present due to its use in certain heat resistant scrap materials.

Cobalt, the chemical sister element of nickel, is also readily accepted in amounts up to about 0.6% without significant effect upon the properties of the alloys of the invention.

Tungsten is present in a very few nickel-base alloys in quantities of from about 1% to 4.5%. This element has also been claimed to be equivalent to half as much molybdenum insofar as the improvement of corrosion resistance is concerned. However, in alloys of the present invention, the presence of tungsten has been found to be synergistic with molybdenum in improving corrosion resistance in many substances. While molybdenum cannot be entirely eliminated from the alloys of the present invention, beneficial effects, such as improved resistance to local corrosion and to highly corrosive acid chloride solutions, are realized from the molybdenum present. Furthermore, those beneficial effects are substantially increased by the presence of even very small amounts of tungsten.

The addition of small amounts of vanadium have also been found to improve the corrosion resistance, especially local corrosion resistance, of the alloys of the invention to many substances. Additions of fractions of a percent by weight of vanadium have a strong tendency to result in finer grain size and less marked dendritic formations in castings as well as in ingots intended for wrought products. The effect of vanadium as a carbide stabilizer has been noted above.

In general, the recovery of titanium in alloys melted and poured in air tends to be very unreliable and inconsistent. This may in part be due to the fact that lumps of titanium and even of ferrotitanium are light enough to float on the surface of molten steels and similar alloys, where they oxidize quite readily. Vanadium, on the other hand, has a density a lot closer to that of molten steels, and its recovery in the amounts desired in alloys of the invention is quite high and relatively consistent.

Accordingly, it has been found desirable and without increased costs, to restrict the alloys of the invention to the following elements and to the ranges of proportions indicated:

| | |
|---|---|
| Nickel | 2.5-4.7% by weight |
| Chromium | 23-28% |
| Molybdenum | 0.50-1% |
| Copper | 0.50-3.7% |
| Nitrogen | 0.08-0.25% |
| Tungsten | 0.10-0.60% |
| Manganese | 0.2-2% |
| Silicon | 0.1-1% |
| Vanadium | 0-0.35% |
| Columbium | 0-0.65% |
| Cobalt | 0-0.6% |
| Boron | 0-0.007% |
| Carbon | 0-0.08% |
| Iron | essentially balance |

By maintaining the instant alloys within those ranges avoids the use of premium purity and therefore higher cost raw materials.

For optimum mechanical properties as cast and when no heat treatment is intended the following ranges of elements have been found to particularly desirable:

| | |
|---|---|
| Nickel | 3.5-4.7% by weight |
| Chromium | 23.2-26.5% |
| Molybdenum | 0.6-0.95% |
| Copper | 0.9-1.85% |
| Nitrogen | 0.08-0.20% |
| Tungsten | 0.10-0.57% |
| Manganese | 0.3-0.8% |
| Silicon | 0.2-0.5% |
| Vanadium | 0.08-0.33% |
| Boron | 0-0.004% |
| Carbon | 0.05% maximum |
| Iron | essentially balance |

Alloys formulated within these ranges of elements have as-cast elongations of about 25% to 35% with elongations in the heat treated condition of about 30% to 40%. These values may be compared to the prior art commercial duplex alloys of 15% to 30% elongations in heat treated condition.

A particularly advantageous alloy having excellent chemical, physical, mechanical and metallurgical properties as melted and without heat treatment has the following composition:

| | |
|---|---|
| Nickel | 3.5% by weight |
| Chromium | 23.7% |
| Molybdenum | 0.7% |
| Copper | 1.8% |
| Nitrogen | 0.12% |
| Tungsten | 0.15% |
| Manganese | 0.5% |
| Silicon | 0.23% |
| Vanadium | 0.10% |
| Boron | 0.0030% |
| Carbon | 0.01% |
| Iron | essentially balance |

For milder corrosion conditions ordinarily met by type 302 stainless steel or basic 18% C-8% Ni type alloys the following ranges of elements have been found to be particularly effective:

| | |
|---|---|
| Nickel | 3.4-5% by weight |
| Chromium | 23-25% |
| Molybdenum | 0.50-0.60% |
| Copper | 0.50-1.3% |
| Nitrogen | 0.08-0.18% |
| Tungsten | 0.10-0.20% |
| Manganese | 0.2-1% |
| Silicon | 0.2-1% |
| Vanadium | 0-0.15% |
| Carbon | 0-0.08% |
| Iron | essentially balance |

When extreme conditions that especially promote intergranular corrosion are to be met, the following ranges of proportions of elements have been found to be particularly advantageous:

| | |
|---|---|
| Nickel | 3.5-5% |
| Chromium | 23-25% |
| Molybdenum | 0.5-0.8% |
| Copper | 0.50-3.7% |
| Nitrogen | 0.10-0.25% |
| Tungsten | 0.15-0.60% |
| Manganese | 0.2-2% |
| Silicon | 0.2-1% |
| Vanadium | 0.10-0.40% |
| Columbium | 0.3-0.65% |
| Boron | 0-0.004% |
| Carbon | 0.03% maximum |
| Iron | essentially balance |

When conditions of very aggressive acid chlorides are to be encountered, the following ranges of elements have been found to be especially effective:

| | |
|---|---|
| Nickel | 3.7-5% by weight |
| Chromium | 23.5-26% |
| Molybdenum | 0.60-1% |
| Copper | 0.95-3.7% |
| Nitrogen | 0.10-0.25% |
| Tungsten | 0.15-0.6% |
| Manganese | 0.2-0.8% |
| Silicon | 0.2-0.8% |
| Vanadium | 0.05-0.4% |
| Columbium | 0-0.050% |
| Boron | 0-0.004% |
| Carbon | 0.03% maximum |
| Iron | essentially balance |

Various concentrations of sulfuric acid represent a wide variety of oxidizing and reducing conditions. For particular resistance to sulfuric acid in concentrations up to about 40% acid, the following ranges of elements have been found to be desirable:

| | |
|---|---|
| Nickel | 3-5% by weight |
| Chromium | 23-25% |
| Molybdenum | 0.50-0.80% |
| Copper | 0 5-3.7% |
| Nitrogen | 0.10-0.25% |
| Tungsten | 0.10-0.5% |
| Manganese | 0.2-0.8% |
| Silicon | 0.2-0.8% |
| Vanadium | 0.08-0.4% |
| Columbium | 0-0.5% |
| Boron | 0-0.004% |
| Carbon | 0-0.08% |

-continued

| | |
|---|---|
| Iron | essentially balance |

For concentrated sulfuric acid solutions above 85% acid, the following ranges of elements have been found to be desirable:

| | |
|---|---|
| Nickel | 3.5–4.8% by weight |
| Chromium | 23–25% |
| Molybdenum | 0.50–0.80% |
| Copper | 0.50–1% |
| Nitrogen | 0.10–0.25% |
| Tungsten | 0.10–0.25% |
| Manganese | 0.2–0.8% |
| Silicon | 0.25–1% |
| Vanadium | 0–0.15% |
| Columbium | 0–0.5% |
| Boron | 0–0.004% |
| Carbon | 0–0.08% |
| Iron | essentially balance |

The following examples further illustrate the invention:

EXAMPLE 1

One hundred pound heats of several different alloys were prepared in accordance with the invention. One hundred pound heats of other alloys were also prepared.

Each of the heats was air-melted in a 100-pound high frequency induction furnace. The composition of the alloys of the invention is set forth in Table IA, with the balance in each instance being essentially iron. The composition of the alloys not of the invention are set forth in Table IB, with the balance in each instance being essentially iron.

TABLE 1A

ALLOYS OF THE INVENTION
PERCENT BY WEIGHT OF ALLOYING ELEMENTS

| ALLOY NUMBER | Ni | Cr | Mo | Cr | N | W | Mn | Si | V | Cb | B | Co | C |
|---|---|---|---|---|---|---|---|---|---|---|---|---|---|
| 1482 | 3.52 | 23.65 | .69 | 1.82 | .12 | .15 | .53 | .23 | .10 | — | .0031 | .17 | .00 |
| 1486 | 4.01 | 24.58 | .71 | 3.62 | .18 | .31 | .73 | .47 | .26 | .33 | .0030 | .05 | .02 |
| 1488 | 3.73 | 24.15 | .65 | .52 | .13 | .15 | .58 | .21 | .09 | .61 | .0027 | — | .06 |
| 1504 | 3.73 | 25.54 | .63 | 1.64 | .22 | .16 | .35 | .18 | .08 | .01 | — | .17 | .00 |
| 1505 | 3.81 | 26.08 | .67 | 1.66 | .21 | .15 | .42 | .26 | .08 | .05 | — | .16 | .00 |
| 1506 | 4.41 | 26.21 | .63 | 1.63 | .15 | .14 | .45 | .22 | .05 | — | — | .17 | .00 |
| 1507 | 4.63 | 25.12 | .88 | .93 | .18 | .57 | .46 | .31 | .33 | .03 | .0030 | .17 | .01 |
| 1508 | 4.75 | 25.16 | .93 | 3.57 | .17 | .59 | .49 | .28 | .26 | .02 | .0027 | .15 | .01 |

TABLE 1B

OTHER ALLOYS
PERCENT BY WEIGHT OF ALLOYING ELEMENTS

| ALLOY NUMBER | Ni | Cr | Mo | Cu | N | W | Mn | Si | V | Cb | B | Co | C |
|---|---|---|---|---|---|---|---|---|---|---|---|---|---|
| 1474 | 3.01 | 24.08 | .31 | .04 | .18 | .16 | .39 | .24 | .09 | — | — | .18 | .01 |
| 1480 | 3.71 | 24.06 | .65 | — | .13 | .14 | .59 | .20 | .11 | — | .0035 | — | .02 |
| 1487 | 3.74 | 24.78 | .69 | — | .14 | — | .60 | .22 | — | — | — | — | .02 |
| 1503 | 3.65 | 24.23 | .44 | .88 | .21 | .16 | .46 | .24 | .07 | .01 | — | .17 | .00 |

Standard mechanical test keel blocks and corrosion test bars were prepared from each heat. Using the test keel blocks, the mechanical properties of the alloys were measured in the as-cast condition and also after a three-hour solution heat treatment at 1950° F. (1065° C.) followed by an oil quench. The as-cast properties are set forth in Table II and the heat treated properties are set forth in Table III.

TABLE II

MECHANICAL PROPERTIES OF ALLOYS AS CAST

| ALLOY NUMBER | TENSILE STRENGTH P.S.I. | YIELD STRENGTH P.S.I. | TENSILE ELONGATION % | BRINELL HARDNESS NUMBER |
|---|---|---|---|---|
| Alloys of the Invention | | | | |
| 1482 | 96,000 | 58,800 | 34.0 | 217 |
| 1486 | 100,200 | 83,200 | 5.0 | 228 |
| 1488 | 93,400 | 71,800 | 16.0 | 205 |
| 1504 | 103,800 | 76,700 | 17.0 | 228 |
| 1505 | 99,800 | 69,200 | 8.5 | 217 |
| 1506 | 99,300 | 71,600 | 31.0 | 228 |
| 1507 | 104,000 | 67,900 | 27.0 | 217 |
| 1508 | 99,900 | 57,500 | 37.0 | 183 |
| Alloys not of the Invention | | | | |
| 1474 | 87,000 | 65,500 | 14.0 | 179 |
| 1480 | 98,300 | 72,700 | 11.5 | 185 |
| 1487 | 95,600 | 74,300 | 12.5 | 210 |
| 1503 | 92,700 | 71,000 | 21.5 | 207 |

TABLE III

| MECHANICAL PROPERTIES OF HEAT TREATED ALLOYS | | | | |
|---|---|---|---|---|
| ALLOY NUMBER | TENSILE STRENGTH P.S.I. | YIELD STRENGTH P.S.I. | TENSILE ELONGATION % | BRINELL HARDNESS NUMBER |
| Alloys of the Invention | | | | |
| 1482 | 97,400 | 63,700 | 35.0 | 196 |
| 1486 | 112,400 | 75,300 | 23.0 | 241 |
| 1488 | 105,200 | 61,100 | 29.0 | 205 |
| 1504 | 86,600 | 56,500 | 28.5 | 196 |
| 1505 | 102,000 | 63,600 | 29.5 | 212 |
| 1506 | 100,000 | 63,600 | 31.5 | 212 |
| 1507 | 97,000 | 54,100 | 38.0 | 207 |
| 1508 | 101,800 | 61,600 | 33.5 | 187 |
| Alloys not of the Invention | | | | |
| 1474 | 90,300 | 62,100 | 33.0 | 196 |
| 1480 | 94,500 | 62,500 | 29.5 | 205 |
| 1487 | 92,400 | 61,500 | 31.5 | 202 |
| 1503 | 98,300 | 71,300 | 23.0 | 196 |

Some of the corrosion test bars were solution heat treated for three hours at 1950° F. (1065° C.) followed by an oil quench to room temperature. Heat treated and non-heat treated corrosion test bars were machined into 1½ inch diameter by ¼-inch thick discs, each disc having a ⅛-inch diameter hole in the center. These discs were then ground to a 240-grit finish and cleaned of all oil and dust particles in a 1,1,1-trichloroethane solution, then washed in a hot water solution with a nylon bristle brush and ordinary dish detergent and water solution, rinsed, and dried on a hot plate at 120° C. (248° F.). Each discs was weighed to the nearest 10,000th of a gram. These discs were then used in the comparative corrosion tests described hereinafter.

EXAMPLE 2

Sample discs of alloy 1486 were tested at room temperature, which was 24° C. (75° F.), in accordance with the procedure of Method A of ASTM STANDARD G48-76 (Reapproved 1980) for testing pitting resistance of alloys by the use of ferric chloride solution. In accordance with the test specification each of three as-cast samples and three heat treated samples was held for 72 hours in a glass cradle immersed in 600 ml of ferric chloride solution contained in a 1000-ml beaker and covered with a watch crystal. The ferric chloride solution was prepared by dissolving 100 gm of reagent grade ferric chloride, $FeCl_3.6H_2O$, in 900 ml of distilled water (about 6% $FeCl_3$ by weight).

Each disc was then scrubbed with a nylon bristle brush under running water to remove corrosion products, soaked in 1000 ml of hot tap water at a temperature of 80° C. (176° F.) for about two hours to dissolve any chloride solution remaining in any pits, rerinsed, and then dried on a hot plate for about an hour at about 120° C. (248° F.). Each specimen was then weighed again to the nearest 10,000th of a gram and the weight lost recorded. For convenience of comparison, the weight loss was converted to a figure of average depth of penetration in mils per year, MPY, in accordance with the relationship:

$$MPY = 393.7 \frac{Wo - Wf}{ATD}$$

where

Wo=Original Weight of Sample

Wf=Final Weight of Sample

A=Area of Sample in Square Centimeters

T=Duration of the Test in Years

D=Density of the Alloy in Grams per Cubic Centimeter

This method of presenting data is used in further examples but it not a true indication of maximum depth of attack or penetration in the ferric chloride test because, in cases of severe attack, penetration at pit sites may reach depths of several times the average. Nevertheless, it gives a comparison of relative severity of attack. The test results of the three-day exposure of alloy 1486 samples in the as-cast and heat treated conditions are given in Table IV.

TABLE IV

| Average MPY Loss in 6% Ferric Chloride Solution at 24° C. (75° F.) of Alloy 1486 | | | |
|---|---|---|---|
| As-Cast Condition | | Heat-Treated Condition | |
| Sample 1 | 300.9 | Sample 1 | 1.7 |
| Sample 2 | 311.2 | Sample 2 | 3.2 |
| Sample 3 | 297.5 | Sample 3 | 2.1 |

The results from these tests indicated good consistency of results with the ferric chloride test on a given alloy. Therefore, all of the alloys listed in Tables IA and IB were submitted to the same 72-hour test at room temperature. The results of the tests for the as-cast samples and for duplicate samples, solution heat treated for three hours at 1950° F. (1065°0 C.), are set forth in Table V.

TABLE V

| AVERAGE MPY LOSS IN 6% FERRIC CHLORIDE SOLUTION AT 24° C. (75° F.) | | |
|---|---|---|
| SAMPLE NUMBER | AS-CAST CONDITION | HEAT TREATED CONDITION |
| Alloys of the Invention | | |
| 1482 | 80.6 | 2.9 |
| 1486 | 311.2 | 1.7 |
| 1488 | 493.7 | 66.3 |
| 1504 | 436.9 | 20.5 |
| 1505 | 362.6 | 9.9 |
| 1506 | 288.0 | 9.5 |
| 1507 | 104.7 | 8.2 |
| 1508 | 45.0 | 2.9 |
| Alloys not of the Invention | | |
| 1474 | 607.0 | 355.3 |
| 1480 | 506.9 | 305.3 |
| 1487 | 487.6 | 178.9 |
| 1503 | 433.8 | 123.8 |

From these results it is obvious that all of the alloys of the invention performed significantly better in the ferric chloride test in the heat treated condition than in the as-cast condition, that some alloys performed much better than others, and that in the heat treated condition alloys of the invention performed better than the comparative alloys.

It is also remarkable that the alloys of the invention, with molybdenum contents of less than 1% in the as-cast condition generally show pitting attack in the 6% ferric chloride test that is roughly comparable to the results obtained with austenitic alloys of about 3% Mo content when they contain about 25% Cr or to those of about 6% Mo when they contain about 18% to 20% Cr. In a similar manner, the solution annealed samples of the alloys of the invention are comparable in the ferric chloride test to 25% Cr austenitic alloys containing about 4% Mo or to 20% Cr austenitic alloys containing about 7% Mo.

The as cast results for alloy 1488 also illustrate that in certain more severe service, such as in acid chlorides, other elements, in this case carbon, can be detrimental when present in an amount greater than the preferred amount. Also, the poor performance of alloy 1503 in the as-cast and the heat treated conditions illustrates the importance of having at least the minimum molybdenum content of 0.50% in the alloys of the invention even though the claimed requirements for copper and tungsten have been met.

EXAMPLE 3

Samples of discs prepared as described in Example 1, were immersed to a depth of about 1¾ inches in natural seawater taken from the Atlantic Ocean at Myrtle Beach, S.C. The seawater was held at room temperature in plastic containers with tightly-fitted lids with a water change every two weeks. After the end of six months, the disc were examined weekly for evidence of pitting, after being rinsed and dried. Observation was made with a 10-power magnifying glass. The number of weeks at which pitting was first observed for each sample is set forth in Table VI below.

TABLE VI

| | As Cast | Heat Treated |
|---|---|---|
| Alloys Of The Invention | | |
| 1486 | 41 Weeks | No Pits |
| 1488 | 35 Weeks | No Pits |
| Alloys Not Of The Invention | | |
| 1474 | 30 Weeks | 36 Weeks |
| 1480 | 39 Weeks | 40 Weeks |
| 1487 | 29 Weeks | 34 Weeks |
| 1503 | 48 Weeks | 46 Weeks |

As cast and heat treated discs of alloys 1482, 1504, 1505, 1506, 1507 and 1508 and heat treated discs of 1486 and 1488 all showed no pits up to the time of 63 weeks exposure.

EXAMPLE 4

Using discs prepared as in Example 1, samples of the invention were suspended by platinum wires in 600 ml beakers containing various concentrations of sulfuric acid-waiter solutions for 24 hours and at various temperatures. The beakers were covered by double watch crystals and maintained at various temperatures on a hot plate.

In some instances there was some water loss at the higher temperatures used over the 24-hour test periods resulting in increases in acid concentration. The alloys of the invention displayed a tendency in the various sulfuric acid strengths toward remaining passive to some approximate temperature at a given acid strength and of these becoming active and corroding rapidly at higher temperatures or acid strengths. There were variations from alloy to alloy, depending upon their element contents and whether or not they were solution heat treated. From these tests the approximate temperature limits for passive corrosion behavior in various sulfuric-acid water strengths were determined. The approximate ranges for these passive temperature limits for the various alloys of the invention are set forth in Table VI. The high temperature limit for passive behavior for each alloy was arbitrarily selected as that temperature above which the corrosive attack exceeded 10 MPY. When the temperatures for each sample in each acid strength exceeded the 10 MPY point by even just a few degrees, the attack would often quickly rise to values of the order of 30 to 80 MPY over the next 20° C. temperature increase. In some instances, the rate of attack would be very much grater over a 10° to 20° C. temperature rise. However, in view of the fact that austenitic 18% Cr-8% Ni alloys generally become active in all sulfuric acid strengths between about 3% and 90% acid even at room temperatures, it is obvious that alloys of the invention possess much greater utility in sulfuric acid solutions than the standard austenitic stainless steels. Alloys of the invention were tested in a similar manner in 70% nitric acid, and the passive temperature limits for that environment are also reported in Table VII.

TABLE VII

TEMPERATURES BELOW WHICH ALLOYS OF THE INVENTION CORRODE AT LESS THAN 10 MPY IN VARIOUS ACID SOLUTIONS

| | | |
|---|---|---|
| 5% | Sulfuric | 90°-110° C. (194°-230° F.) |
| 10% | Sulfuric | 90°-110° C. (194°-230° F.) |
| 25% | Sulfuric | 25°-80° C. (77°-176° F.) |
| 40% | Sulfuric | 80°-110° C. (176°-230° F.) |
| 50% | Sulfuric | 20°-40° C. (68°-104° F.) |
| 95.6 | Sulfuric | 80°-100° C. (176°-212° F.) |
| 70% | Nitric | 80°-95° C. (176°-203° F.) |

EXAMPLE 5

The ASTM A-262 procedure of testing metallic samples in boiling 65% nitric acid for 48-hour periods determines susceptability to intergranular corrosion due to formation of chromium carbides at the metallic grain boundaries. However, this test also causes rapid corrosion in metals which contain sigma phase. In that procedure the metallic sample is immersed in a 1000 ml Erlenmeyer flask equipped with a cold finger-type condenser as a top closure. The acid solution in this test is kept at a boil for 48-hour periods on a hot plate.

Alloys of this invention in the as-cast condition, typically suffer from about 40 to about 400 MPY attack in this test, depending to an extent upon carbon content. The attack is reduced to about 3 to 9 MPY when carbon contents are held to about 0.03% maximum and a solution heat treatment and rapid cool are employed. Alternatively, the carbon may be toward the maximum end of the range if sufficient amounts of the carbide stabilizing elements discussed above are present and a heat treatment is employed. In this manner, the alloys of the invention differ from stabilized standard austenitic stainless steels which do not ordinarily form sigma phase. However, alloys of the invention are again similar to the austenitic stainless steels in that they have generally good resistance to oxidizing substances even in the unheat-treated condition.

After the ASTM A-262 procedure of testing in boiling 65% nitric acid for 48-hour periods had been adapted as a standard, it was learned that the corrosion of stainless steels in very strong solutions of nitric acid is accompanied by the formation of hexavalent chromium ions that increase the corrosivity of the nitric acid solution by a factor as much as a hundred times or more. In the process of testing in small flasks of acid, some of the acid is consumed so that the acid strength varies from the desired concentration within a relatively short period. This makes is somewhat difficult to various corrosivities at acid strengths above about 60%. More consistent comparative results may be had with solutions of lower acid strengths and shorter test periods. Accordingly, as-cast and heat-treated samples of the alloys of the invention were tested for 24-hour periods in boiling 25% nitric acid. The results of these tests are set forth in Table VIII using discs prepared as described in Example 1.

TABLE VIII

| ALLOY NUMBER | ATTACK IN MPY IN BOILING 25% NITRIC ACID: AS-CAST CONDITION | SOLUTION HEAT TREATED CONDITION |
|---|---|---|
| 1482 | 9.5 | 4.8 |
| 1486 | 9.9 | 5.3 |
| 1488 | 7.8 | 4.6 |
| 1504 | 8.6 | 5.8 |
| 1505 | 8.8 | 5.6 |
| 1506 | 9.3 | 5.3 |
| 1507 | 6.5 | 2.9 |

Stainless steels may be called upon to handle higher concentrations of nitric acid but not at boiling temperatures. Test discs as employed above were tested in 70% nitric acid at 80° C. (176° F.). These discs were in the as-cast condition. The results of these tests are set forth in Table IX. From these results it is obvious that is solution heat treatment need not always be employed for alloys of the invention to provide excellent corrosion resistance in certain nitric acid solutions.

TABLE IX

| ALLOY NUMBER | MPY | ALLOY NUMBER | MPY |
|---|---|---|---|
| ATTACK IN MPY IN 70% NITRIC ACID AT 80° C. (176° F.) | | | |
| 1482 | 3.2 | 1505 | 2.0 |
| 1486 | 8.2 | 1506 | 1.9 |
| 1488 | 2.9 | 1507 | 2.3 |
| 1504 | 2.1 | 1508 | 3.7 |

EXAMPLE 6

Test discs as described in Example 1 were tested for six hours in boiling solutions of 0.1 normal sulfuric acid plus 5% sodium chloride, 0.8% sodium chloride plus 0.5% citric acid and 3% sodium chloride. Comparative alloys which also were tested had the nominal compositions shown in Table X.

TABLE X

| ALLOY NUMBER | Ni | Cr | Mo | Cr | N | Mn | Si |
|---|---|---|---|---|---|---|---|
| 304 | 8 | 18 | — | — | — | .8 | .6 |
| 317L | 13 | 19 | 3.5 | — | — | .8 | .6 |

TABLE X-continued

| ALLOY NUMBER | Ni | Cr | Mo | Cr | N | Mn | Si |
|---|---|---|---|---|---|---|---|
| 255 | 6 | 25 | 3 | 2 | .20 | .8 | .5 |

Type 304 is the basic 18% C-8% Ni stainless steel, while type 317L is the most corrosion resistant variation of all the standard austenitic types. Alloy 255 is a prominent commercial duplex stainless steel. The results of these tests are set forth in Table XI. Alloy 255 was in the solution heat treated condition, while all other samples were as cast.

TABLE XI

| ALLOY NUMBER | MPY ATTACK IN BOILING SOLUTIONS: 0.1 N $H_2SO_4$ + 5% NaCl | 0.8% NaCl + 0.5% CITRIC ACID | 3% NaCl |
|---|---|---|---|
| Alloys of the Invention | | | |
| 1482 | 8.6 | 7.6 | 0.1 |
| 1486 | 5.9 | 0.0 | 1.4 |
| 1488 | 972.3 | 7.5 | 5.5 |
| 1504 | 8.2 | 6.6 | 1.4 |
| 1505 | 8.4 | 6.4 | 7.5 |
| 1506 | 7.6 | 6.2 | 1.3 |
| 1507 | 9.6 | 7.1 | 2.1 |
| 1508 | 7.4 | — | — |
| 304 | 1858.3 | 93.4 | 96.5 |
| 317L | 148.0 | 31.0 | 1.0 |
| 255 | 1.0 | 1.2 | 0.4 |
| Alloys not of the Invention | | | |
| 1474 | 1738.4 | 7.4 | 2.7 |
| 1480 | 879.6 | 6.8 | 1.2 |
| 1487 | 972.9 | 7.1 | 1.8 |
| 1503 | 9.4 | 7.7 | 6.3 |

EXAMPLE 7

Test discs as described in Example 1 were tested for six hours in boiling solutions of 10% and 25% acetic acid. These discs were in the as-cast condition. The results of these tests are set forth in Table XII.

TABLE XII

| ALLOY NUMBER | MPY ATTACK IN BOILING ACETIC ACID-WATER SOLUTIONS: 10% ACID | 25% ACID |
|---|---|---|
| Alloys Of The Invention | | |
| 1482 | 3.1 | 7.5 |
| 1486 | 0.9 | 6.1 |
| 1488 | 0.7 | 5.7 |
| 1504 | 0.6 | 2.8 |
| 1505 | 0.0 | 2.0 |
| 1506 | 1.4 | 4.2 |
| 1507 | 0.7 | 3.8 |
| Alloys Not Of The Invention | | |
| 1474 | 0.6 | 1.8 |
| 1480 | 2.0 | 4.4 |
| 1487 | 1.1 | 6.6 |
| 1503 | 0.8 | 3.5 |

In alloys based upon iron and nickel the two elements most employed to provide resistance to reducing chemical substances are nickel, when present in large amounts up to 60%, and molybdenum. Even in the molybdenum-bearing grades of standard austenitic stainless steels the amount of each of these two elements is comparatively so low that these steels have very low resistance to reducing substances. The nickel and molybdenum contents of the alloys of the present invention are even lower, and yet, in practical situations, these alloys have somewhat better resistance in many reducing conditions than the standard alloys.

As sulfuric acid is added to water, the solubility of oxygen in the solution drops rapidly at first, while hydrogen ion concentration rises rapidly to a maximum at around 25% acid and then begins to drop again. Standard stainless steels are active in hot 25% sulfuric acid and are rapidly destroyed.

With substantially higher chromium levels than the 18% Cr-8% Ni steels, the alloys of the present invention are better able to develop some degree of passivity with the reduced oxygen contents found in 25% sulfuric acid in contact with air. The alloys therefore have somewhat better resistance than standard grades to sulfuric acid strengths between about 10% and 45%. The presence of even small amounts of strong oxidizing substances in these sulfuric acid ranges considerably enhances the ability of standard stainless steels to develop some degree of passivity. The same is true for alloys of the present invention. Sample discs such as those of Example 1 were tested for 24 hours at 80° C. (176° F.) in 10%, 25% and 40% sulfuric acid to which had been added ¼% of nitric acid. The results of these tests are set forth in Table XIII.

TABLE XIII

| MPY ATTACK AT 80° C. IN SOLUTIONS OF SULFURIC ACID PLUS ¼% NITRIC ACID | | | |
|---|---|---|---|
| ALLOY NUMBER | 10% $H_2SO_4$ | 25% $H_2SO_4$ | 40% $H_2SO_4$ |
| 1482 | NIL | 1.1 | 1.7 |
| 1486 | NIL | 0.8 | 1.3 |
| 1488 | NIL | 0.6 | 1.7 |
| 1504 | NIL | 0.9 | 1.4 |
| 1505 | NIL | 0.6 | 1.3 |
| 1506 | NIL | 0.6 | 1.4 |
| 1507 | NIL | 0.5 | 1.5 |

The foregoing description of the several embodiments of the invention is not intended as limiting of the invention. As will be apparent to those skilled in the art variations and modifications of the invention may be made without departure from the spirit and scope of this invention.

What is claimed is:

1. A low-nickel low-molybdenum content austenitic-ferritic stainless steel alloys having excellent resistance to pitting corrosion comprising:

| | |
|---|---|
| Nickel | 2–5% by weight |
| Chromium | 23–28% |
| Molybdenum | 0.50–1% |
| Copper | 0.50–4% |
| Nitrogen | 0.08–0.32% |
| Tungsten | 0.10–0.60% |
| Carbon | 0.08% maximum |
| Iron | essentially balance |

wherein the ratio of austenite to ferrite is in the range of 60% to 40% and 40% to 60%, respectively.

2. A low-nickel low-molybdenum content austenitic-ferritic stainless steel alloy having excellent resistance to pitting corrosion comprising:

| | |
|---|---|
| Nickel | 2–5% by weight |
| Chromium | 23–28% |
| Molybdenum | 0.50–1% |
| Copper | 0.50–4% |
| Nitrogen | 0.08–0.32% |
| Tungsten | 0.10–0.60% |

-continued

| | |
|---|---|
| Carbon | 0.008% maximum |
| Manganese | up to 2% |
| Silicon | up to 1% |
| Vanadium | up to 0.45% |
| Columbium | up to 0.65% |
| Tantalum | up to 0.6% |
| Titanium | up to 0.5% |
| Cobalt | up to 0.6% |
| Boron | up to 0.007% |
| Iron | essentially balance |

wherein the ratio of austenite to ferrite is in the range of 60% to 40% and 40% to 60%, respectively.

3. An alloy of claim 1 wherein the carbon content is 0.03% maximum.

4. An alloy of claim 2 wherein the austenite-ferrite ratio is about 50% to 50%.

5. An alloy of claim 2 wherein the copper content is 3.7% maximum.

6. An alloy of claim 2 wherein the copper content is from 1.6% to about 1.8%.

7. An alloy of claim 1 consisting essentially of:

| | |
|---|---|
| Nickel | 2.5–4.7% by weight |
| Chromium | 23–28% |
| Molybdenum | 0.50–1% |
| Nitrogen | 0.08–0.25% |
| Copper | 0.50–3.7% |
| Manganese | 0.2–2% |
| Silicon | 0.1–1% |
| Tungsten | 0.10–0.60% |
| Columbium | 0–0.65% |
| Vanadium | 0–0.35% |
| Cobalt | 0–0.6% |
| Boron | 0–0.007% |
| Carbon | 0–0.08% |
| Iron | essentially balance |

8. An alloy of claim 1 consisting essentially of:

| | |
|---|---|
| Nickel | 3.5–4.7% by weight |
| Chromium | 23.2–26.5% |
| Molybdenum | 0.6–0.95% |
| Nitrogen | 0.08–0.20% |
| Copper | 0.9–1.85% |
| Manganese | 0.3≧0.8% |
| Silicon | 0.2–0.5% |
| Tungsten | 0.10–0.57% |
| Vanadium | 0.8–0.33% |
| Boron | 0–0.004% |
| Carbon | 0.05% maximum |
| Iron | essentially balance |

9. An alloy of claim 4 consisting essentially of:

| | |
|---|---|
| Nickel | 3.5% by weight |
| Chromium | 23.7% |
| Molybdenum | 0.7% |
| Nitrogen | 0.12% |
| Copper | 1.8% |
| Manganese | 0.5% |
| Silicon | 0.23% |
| Tungsten | 0.15% |
| Vanadium | 0.10% |
| Boron | 0.0030% |
| Carbon | 0.01% maximum |
| Iron | essentially balance |

10. An alloy of claim 4 consisting essentially of:

| | |
|---|---|
| Nickel | 3.4–5% by weight |

-continued

| | |
|---|---|
| Chromium | 23–25% |
| Molybdenum | 0.50–0.60% |
| Copper | 0.50–1.3% |
| Nitrogen | 0.08–0.18% |
| Manganese | 0.2–1% |
| Silicon | 0.2–1% |
| Tungsten | 0.10–0.20% |
| Vanadium | 0–0.15% |
| Carbon | 0–0.08% |
| Iron | essentially balance |

11. An alloy of claim 4 consisting essentially of:

| | |
|---|---|
| Nickel | 3.5–5% by weight |
| Chromium | 23–25% |
| Molybdenum | 0.5–0.8% |
| Nitrogen | 0.10–0.25% |
| Copper | 0.50–3.7% |
| Manganese | 0.2–2% |
| Silicon | 0.2–1% |
| Tungsten | 0.15–0.60% |
| Vanadium | 0.10–0.40% |
| Columbium | 0.3–0.65% |
| Boron | 0–0.004% |
| Carbon | 0.03% maximum |
| Iron | essentially balance |

12. An alloy of claim 4 consisting essentially of:

| | |
|---|---|
| Nickel | 3.7–5% by weight |
| Chromium | 23.5–26% |
| Molybdenum | 0.65–1% |
| Nitrogen | 0.15–0.30% |
| Copper | 0.95–3.7% |
| Manganese | 0.2–8% |
| Silicone | 0.2–0.8% |
| Nitrogen | 0.10–0.25% |
| Tungsten | 0.15–0.6% |
| Vanadium | 0.05–0.4% |
| Columbium | 0–0.050% |
| Boron | 0–0.004% |
| Carbon | 0.03% maximum |
| Iron | essentially balance |

13. An alloy of claim 4 consisting essentially of:

| | |
|---|---|
| Nickel | 3–5% by weight |
| Chromium | 23–25% |
| Molybdenum | 0.50–0.8% |
| Nitrogen | 0.10–0.25% |
| Copper | 0.5–3.7% |
| Manganese | 0.2–0.8% |

-continued

| | |
|---|---|
| Silicone | 0.2–0.8% |
| Tungsten | 0.10–0.5% |
| Vanadium | 0.08–0.4% |
| Columbium | 0–0.5% |
| Boron | 0–0.004% |
| Carbon | 0–0.08% |
| Iron | essentially balance |

14. An alloy of claim 4 consisting essentially of:

| | |
|---|---|
| Nickel | 3.5–4.8% by weight |
| Chromium | 23–25% |
| Molybdenum | 0.50–0.8% |
| Nitrogen | 0.10–0.25% |
| Copper | 0.50–1% |
| Manganese | 0.2–0.8% |
| Silicon | 0.10–0.25% |
| Tungsten | 0.10–0.25% |
| Vanadium | 0–0.015% |
| Columbium | 0–0.5% |
| Boron | 0–0.004% |
| Carbon | 0–0.08% |
| Iron | essentially balance |

15. An alloy consisting essentially of:

| | |
|---|---|
| Nickel | 4.01% by weight |
| Chromium | 24.6% |
| Molybdenum | 0.71% |
| Copper | 3.62% |
| Nitrogen | 0.18% |
| Manganese | 0.73% |
| Silicon | 0.47% |
| Vanadium | 0.26% |
| Tungsten | 0.31% |
| Columbium | 0.33% |
| Boron | 0.003% |
| Cobalt | 0.05% |
| Carbon | 0.02% |

16. An alloy consisting essentially of:

| | |
|---|---|
| Nickel | 3.71% |
| Chromium | 24.06% |
| Molybdenum | 0.65% |
| Nitrogen | 0.13% |
| Manganese | 0.59% |
| Silicon | 0.20% |
| Vanadium | 0.11% |
| Tungsten | 0.14% |
| Boron | 0.0035% |
| Carbon | 0.02% |

* * * * *